US005810751A

United States Patent [19]

Meier et al.

[11] Patent Number: 5,810,751

[45] Date of Patent: Sep. 22, 1998

[54] BACK-SPINE-NEUROLOGICAL THERAPY APPARATUS

[75] Inventors: Robert H. Meier, Ann Arbor; Gary W. Gray, Adrian, both of Mich.

[73] Assignee: Spectrum Therapy Products, Inc., Jasper, Mich.

[21] Appl. No.: 514,843

[22] Filed: Aug. 14, 1995

[51] Int. Cl.[6] ..... A61H 1/00

[52] U.S. Cl. ..... 601/24; 601/23; 482/131; 482/139; 482/146

[58] Field of Search ..... 482/131, 132, 482/144, 146, 147, 148, 139, 907, 142; 472/29, 40, 41, 44, 47, 135; 297/271.5, 258.1; 601/23, 24, 26, 86, 90, 98

[56] References Cited

U.S. PATENT DOCUMENTS

| | | | |
|---|---|---|---|
| 1,283,210 | 10/1918 | Kinney | 482/146 |
| 3,749,399 | 7/1973 | Fedor et al. | 472/135 |
| 3,859,736 | 1/1975 | Hill et al. | 482/146 |
| 3,984,100 | 10/1976 | Firster | 482/146 |
| 4,025,107 | 5/1977 | Chippa | 297/258.1 |
| 4,084,273 | 4/1978 | Haynes | 472/135 |
| 4,193,592 | 3/1980 | Bishow | 482/146 |
| 4,653,748 | 3/1987 | Seel et al. . | |
| 4,986,534 | 1/1991 | Meier et al. . | |
| 5,070,863 | 12/1991 | McArthur et al. . | |
| 5,209,223 | 5/1993 | McGorry et al. . | |
| 5,324,247 | 6/1994 | Lepley . | |

FOREIGN PATENT DOCUMENTS

| | | | |
|---|---|---|---|
| 2288539 | 5/1976 | France | 482/146 |
| 2510895 | 2/1983 | France | 482/146 |
| 90/14865 | 12/1990 | WIPO | 601/26 |

*Primary Examiner*—Jeanne M. Clark
*Attorney, Agent, or Firm*—Duncan F. Beaman

[57] ABSTRACT

Therapy apparatus for the exercise of the patient's trunk, back, spine, abdomen and shoulders consisting of a platform having a periphery and upper and lower sides. A pedestal or column extending vertically above the platform upper side supports a seat receiving the patient, and the platform lower side includes a central supporting projection extending below the platform periphery wherein the platform will engage a flat supporting surface, such as the floor, at the support projection and the platform periphery in a tilted manner and a patient located upon the seat may shift their weight to change the angle of platform tilting for exercising the patient's trunk, back, spine, shoulders and torso muscles and ligaments. Support projections of various vertical dimension may be employed to vary the extent of tilting from the vertical, and the apparatus may be utilized with computerized equipment to obtain accurate determination of the extent of exercise and body flexibility.

3 Claims, 2 Drawing Sheets

BACK-SPINE-NEUROLOGICAL THERAPY APPARATUS

BACKGROUND OF THE INVENTION

1. Field of the Invention

The invention pertains to exercise devices for exercising the patient's trunk, back, spine and other torso muscles and ligaments while isolating the patient's trunk from their lower extremities.

2. Description of the Related Art

Presently, rehabilitation exercise devices for exercising the patient's trunk, spine and torso while isolating the patient's trunk from the lower extremities has primarily consisted of large rubber balls upon which the patient sits and moves around by use of the feet. As the patient moves their torso to endeavor to maintain a vertical orientation as the ball rolls across the floor, the movement of the patient's back will provide rehabilitative exercise of the trunk muscles which aid in the strengthening of those muscles which produce greater trunk stability and such exercising may improve lower back pain in patients afflicted with the same.

Such large rubber balls have the drawback of having no clinical controls of the range of motion or muscle activity produced, and patients may receive excessive or too little motion or muscle stressing.

Expensive and complicated torso exercising apparatus is known wherein the patient is seated and the range of motion can be closely regulated. Devices of this type are shown in U.S. Pat. Nos. 5,070,863, 5,209,223 and 5,324,247. However, such devices are very expensive and require specially trained therapists for proper use.

Ankle and lower limb exercise and therapy can be accomplished by using a platform having a lower central support projection extending below the platform periphery wherein the patient places the limb to be exercised upon the platform upper surface and by nutating the platform by the patient shifting weight, an angular exercising of the limb muscles is achieved and such a device has been effective for limb rehabilitation as illustrated in U.S. Pat. No. 4,653,748. This concept of leg and ankle rehabilitation by use of a nutating platform wherein the platform movement and weight distribution can be accurately determined and monitored and computed by computer is shown in U.S. Pat. No. 4,986,534.

3. Objects of the Invention.

It is an object of the invention to provide an inexpensive exercise and therapy apparatus for the trunk and spine wherein the apparatus may be used by the patient with little or no supervision, and wherein the range of motion of the patient's trunk, spine and back movements can be controlled and adjusted.

Another object of the invention is to provide rehabilitation apparatus for the back and spine and to provide neurological therapy by the use of a nutatable platform supporting a patient's seat, and the patient may control the rate of chair and seat nutation, and the frequency of muscle extension and contraction.

Another object of the invention is to provide rehabilitation and exercise apparatus for the back and spine wherein the patient's trunk is isolated from lower extremities and wherein an enhanced range of motion to the spine is achieved, and an enhanced strength of all muscles involved in trunk stability including paraspinal uprights and abdominals are produced.

A further object of the invention is to provide a low cost therapy apparatus for the patient's back and spine wherein the trunk is isolated from the lower extremities and wherein spinal segments are mobilized in a weight bearing position in a clinically controlled graduated progressive manner, and wherein the core proprioceptive system is enhanced for improved neurological control for producing greater trunk stability and balance.

Yet another object of the invention is to provide therapy apparatus for the back and spine wherein the type and range of exercising movement may be controlled, and the principles of the invention may be employed with a simplified form of the equipment, or used with computerized apparatus for providing accurate diagnostic information.

SUMMARY OF THE INVENTION

To achieve the aforementioned objects in a relatively simple therapy exercising device, in its basic form, the invention consists of a seat which is supported upon a platform capable of nutation upon a supporting surface, such as the floor. The seat is mounted upon the platform at a conventional seat height whereby the patient may place their feet upon the floor, or upon the platform. The central lower region of the platform is supported by a convex projection or ball which extends below the platform periphery. The platform periphery is usually of a circular configuration, but may be slightly oval or elliptical, if desired.

Because the platform is supported upon the central projection and a peripheral location, the fact that the projection extends below the periphery causes the platform to "tilt" with respect to the vertical. The extent of such tilting will be determined by the distance the lowermost portion of the projection extends below the platform periphery. Accordingly, it will be appreciated that a patient located in the seat in the normal manner will also be tilted or tipped with respect to the vertical. 'Of course, the patient's natural sense of balance will cause the patient to attempt to align their trunk axis and spine with the vertical regardless of the tilted support provided by the seat, and this flexing of the trunk and torso toward the vertical will produce a stretching and contraction of the muscles, ligaments and other trunk components.

By shifting their weight in a circular manner on the seat, the patient's weight imposed upon the platform will cause the position of the platform periphery in engagement with the supporting surface to change in order to align the periphery supporting point with the direction of the patient's weight. Because the central projection supporting the platform is of a convex rounded configuration, it is not possible to "balance" the platform in a vertical orientation wherein the platform axis is truly vertical and the platform periphery is not in engagement with the supporting surface. Hence, the platform will always be in a tilted orientation due to its two point support provided by the projection and the platform periphery. In most exercises, the patient will move their trunk in a circular direction endeavoring to maintain the trunk and spine axis in a substantially vertical orientation. This movement of the trunk will cause the platform to nutate about its periphery and in the normal exercise movement, the entire platform periphery will sequentially engage the supporting surface, usually the floor. Of course, it is also possible for the patient to move the trunk in a partial circle or a to-and-fro movement which will produce a partial nutation cycle of the platform if particular muscles are to be exercised.

As the movement or nutation of the platform and seat occurs, the patient will endeavor to maintain the trunk and spine in a substantially vertical orientation. This movement of the trunk and spine provides the desired trunk exercise, and the many muscles of the trunk and upper body are extended and contracted. Such movement of the trunk and upper body has proven to be very helpful with mechanical low back pain patients, patients having spinal disc problems, neurodeficient patients including those suffering from strokes, closed head injuries or multiple sclerosis. Additionally, the exercise produced by the invention strengthens abdominal walls such as needed with post-partum women, and the shoulder movement provided is effective in shoulder rehabilitation instances.

The range of motion produced by the apparatus of the invention can be adjusted by varying the degree of platform and seat tilting with respect to the vertical. Such adjustment is preferably achieved by using a variety of projections of different vertical dimension and configuration at the platform central region underside. In this manner, the extent of platform tilting may be controlled, and the greater height of projection used produces the greater tilting angle. Of course, the greater the tilting angle, the greater the flexing of the patient's torso is required to maintain a substantially vertical torso and spine orientation. Preferably, the seat is vertically positionable with respect to the platform to accommodate different sizes of patients, and the seat may be rotatable upon its supporting column. Additionally, the seat may or may not include arm rests or back rests, depending upon the type of exercise desired.

While most versions of the platform will have a circular periphery, it is also possible to form the platform periphery in a slight oval or non-circular configuration in order to vary the extent of platform tilting during each nutating rotation. Also, it is possible to offset the axis of the seat support from the vertical axis of the platform in order to modify the seat movement produced as the platform nutates.

It is also possible to utilize the concepts of the invention with computerized apparatus such as that shown in U.S. Pat. No. 4,986,534wherein the location and degree of weight imposed upon a particular portion of the platform periphery may be sensed and analyzed by computer wherein the weight imposed upon various portions of the platform periphery may be detected, and analysis of the readout will permit diagnosis of those trunk muscles which are flexing the greatest and in which direction to permit an accurate analysis of trunk and spine flexibility and therapy.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

With reference to FIGS. 1–5, therapy apparatus in accord with the invention includes a platform generally indicated at 10 which is preferably molded of a rigid urethane foam but can be formed of other materials. The platform 10 supports a seat 12 mounted on the column generally indicated at 14 which defines the axis of the platform. The platform 10 includes a domed convex upper surface 16, FIG. 2, and a concave lower or under surface 18. The central region of the platform 10 is indicated at 20.

Figure 1:
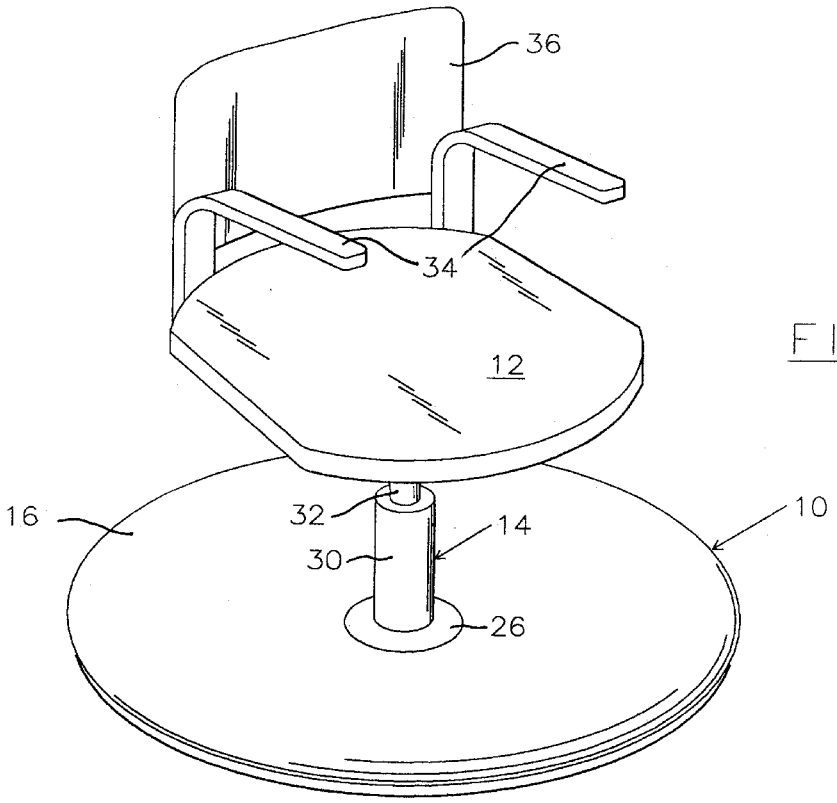
FIG. 1 is a perspective view of back, spine and neurological therapy apparatus in accord with the invention illustrating a seat having detachable arm rests and a detachable back rest.
Figure 2:
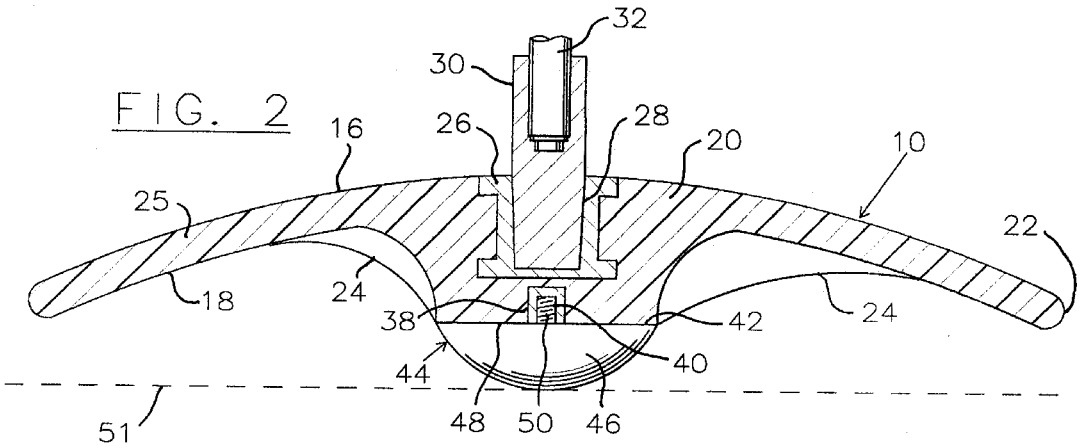
FIG. 2 is a diametrical sectional view through the platform, illustrating the platform axis in a vertical orientation.

The platform periphery 22, in the embodiment of FIGS. 1–5, is of a circular configuration, and as will be appreciated from FIG. 2, in cross section, is of a rounded radiused shape. The underside 18 of the platform may include a plurality of radially extending ribs 24, five ribs being shown in the disclosed embodiment, which reinforce the thinner lip portion of the platform as indicated at 25. A metal insert 26 is integrally molded into the platform 10 concentric with the platform axis and the insert 26 includes a tapered socket 28 which is open with respect to the top of the platform. A metal column base 30 is provided with a tapered lower surface which firmly seats within the socket 28, and the base 30 supports the adjustable gas spring portion 32 of the column 14 upon which the seat 12 is mounted. The gas spring 32 may be adjustable in length to accommodate various sizes of patients, and preferably, the seat 12 is rotatably mounted upon the upper end of the gas spring 32.

The seat 12 may include removable arm rests 34 and a removable seat back 36 which are selectively mounted or removed from the seat 12 depending on the nature of the desired exercise.

As will be appreciated from FIG. 2, the platform central region 20 is of a much greater vertical thickness or dimension than the lip 25, and a lower insert 38 is integrally molded into the lower portion of the central region 20 concentric to the insert 26. The metal insert 38 is provided with a threaded hole 40, and the insert and threaded hole intersect the platform central region lower flat surface 42 which is perpendicular to the vertical axis of the platform as viewed in FIG. 2.

The support of the central region of the platform is by a projection or ball 44 which has a convex outer surface 46, which usually, will constitute a segment of a sphere. The projection 44 may be molded of a rigid synthetic material, and includes a flat surface 48 which intersects the convex surface 46. The radius of the surface 46 is determined such that the diameter of the flat surface 48 is substantially equal to the diameter of the platform surface 42 whereby the outer perimeter of the projection 44 will substantially coincide with the diameter of the flat surface 42 as is apparent in FIG. 2.

The projection 44 includes a threaded stem 50 perpendicularly extending from the center of the surface 48 and the threads of the stem 50 match with those of the insert hole 40 whereby the stem 50 may be threaded into the insert hole 40 until the surfaces 42 and 48 engage as shown in FIG. 2. Accordingly, with the projection or ball 44, resting upon a flat hard supporting surface such as floor 51, FIG. 2, and if the platform 10 is held in the position of FIG. 2 wherein the vertical axis of the platform and column 14 is vertically oriented, the lowermost portion of the projection surface 46 will be engaging the floor 51 and the platform periphery 22 will be spaced above the floor 51.

Of course, the platform 10 would not maintain the vertical orientation of FIG. 2 unless it was perfectly balanced upon the projection 44. Preferably, the projection surface 46 does not have a central flat surface, and the normal position of the platform and seat assembly would be a tipped or tilted position wherein a point on the platform periphery 22 will engage the floor 51 and the support of the assembly will be by the projection 44 and the floor engaging peripheral point.

In use, the patient, not shown, will sit upon the seat 12, and initially, the patient's feet will be located upon the floor 51 in that the diameter of the platform 10 is preferably small enough to permit the seated occupant's feet to engage the floor. With the patient's feet upon the floor, it is possible to vertically orient the platform and column vertical axis so that the patient feels comfortable prior to beginning the exercising therapy.

To begin the therapy exercise, the patient, with the feet on the floor, may then begin to shift their weight upon the seat and relative to the vertical axis. This shifting of the weight will cause the platform 10 to tilt until that portion of the periphery 22 engages the floor 51 which is along the platform radius wherein the majority of the weight is distributed. Once the patient is comfortable with the tipped orientation of the seat 12, the patient may then begin to shift their weight in a circular manner to cause sequential portions of the platform periphery 22 to engage the floor 51 causing the platform 10 to nutate about its vertical axis. During such nutating platform movement, the patient will endeavor to flex their trunk and torso so as to maintain the trunk and torso substantially vertical to compensate for the tilting movement of the apparatus. The patient is able to control the rate of nutation and muscular flexing, and preferably, the patient's rate of weight shifting is such that a uniform and steady flexing of the patient's body during the nutation of the platform and chair will be comfortable. Once the patient is comfortable with the action of the therapy apparatus, the patient's feet may, if desired, be placed upon the platform upper surface 16 so that control of the rate of platform nutation is solely by the shifting of the patient's weight, and not from forces applied to the floor by the patient. Whether the patient's feet should be on the floor 51, or upon the platform 10, may be determined by the therapist to achieve the optimum trunk and torso flexing for the particular malady being treated.

The degree of orientation of the vertical axis of the platform 10 and column 12 as to determine the amount of flexing required by the patient to maintain a substantially vertical orientation can be increased or decreased by raising and lowering the height of the seat 12 by raising or lowering the seat through the gas spring 32. The closer the seat 12 is to the platform 10, the less dimensional offsetting from the vertical axis is achieved.

The operational characteristics of the therapy apparatus can also be varied by raising or lowering the vertical dimension of the projection or ball 44. It will be apparent from FIG. 2 that the closer the platform central region surface 42 is to the floor 51, the less tilting of the platform is required before the periphery 22 engages the floor 51, and the greater the distance of the surface 42 from the floor 51, the greater the degree of platform tilting.

Figure 3:
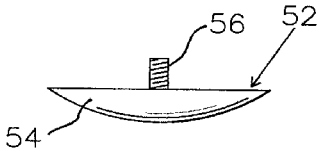
FIGS. 3 and 4 illustrate different sizes and shapes of platform supports or balls which may be selectively used with the platform.

FIG. 3 illustrates a small projection 52 having a spherical segment convex surface 54, and the projection 52 includes a stem 56 for threading into the platform lower insert hole 40. As will be appreciated from FIG. 3, the vertical dimension of the surface 54 is significantly less than the vertical dimension of the surface 46 defined upon the projection 44.

Figure 4:
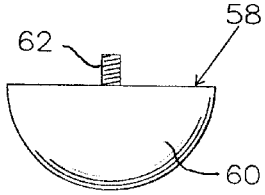
Figure 5:
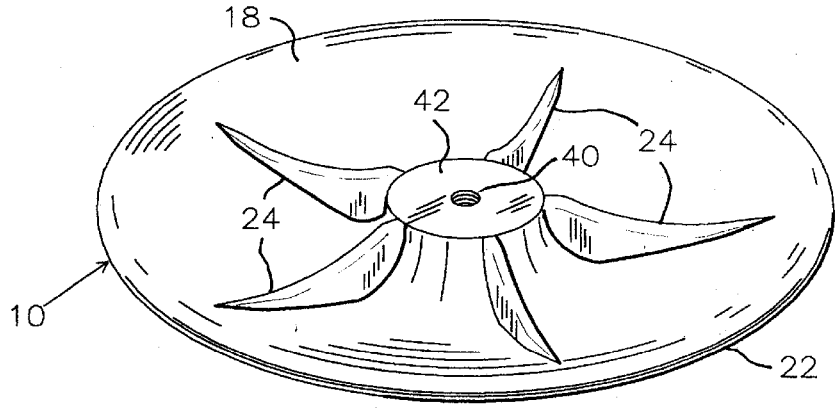
FIG. 5 is an underside perspective view of the platform, per se.

FIG. 4 illustrates a projection 58 having a spherical segment surface 60 of lesser radius than the spherical surfaces shown in FIGS. 2 and 3 which increases the vertical dimension of the surface 60 with respect to the comparable surfaces shown in the projections of FIGS. 2 and 3. The stem 62 extends from the upper flat surface of the projector 58 for selective reception within the insert hole 40.

When the therapy apparatus shown in FIGS. 1–5 is sold, three different sizes of projections or balls are provided as shown in FIGS. 2–4, and in this manner, the patient, or therapist, may select that size most appropriate to the patient's therapy and extent of exercise desired.

Instead of the patient shifting their weight in a circular movement to produce a 360° nutation of the platform 10, it is also possible for the patient to shift their weight in a back and forth or swaying motion so that the complete peripheral configuration of the platform does not engage the floor 51. Variations in the distribution of the patient's weight may be recommended by the therapist for the particular type of exercise and muscle flexation desired, and it will be appreciated that the therapy apparatus described is capable of a variety of trunk and torso exercises wherein the patient's weight is borne upon the seat 12 and the trunk is isolated from the lower extremities with respect to weight distribution.

If it is desired to analyze the nutation of the platform 10 so that an accurate computing of the patient's weight distribution and muscle flexing can be determined, it is possible to use the inventive concept with computerized equipment. The type of computerized equipment with which the invention may be utilized is shown in U.S. Pat. No. 4,986,534, and the disclosure of this patent is herein incorporated by reference, and the apparatus shown in FIG. 6 substantially operates in the same manner as described in U.S. Pat. No. 4,986,534 as adapted to the inventive concepts as explained below.

Figure 6:
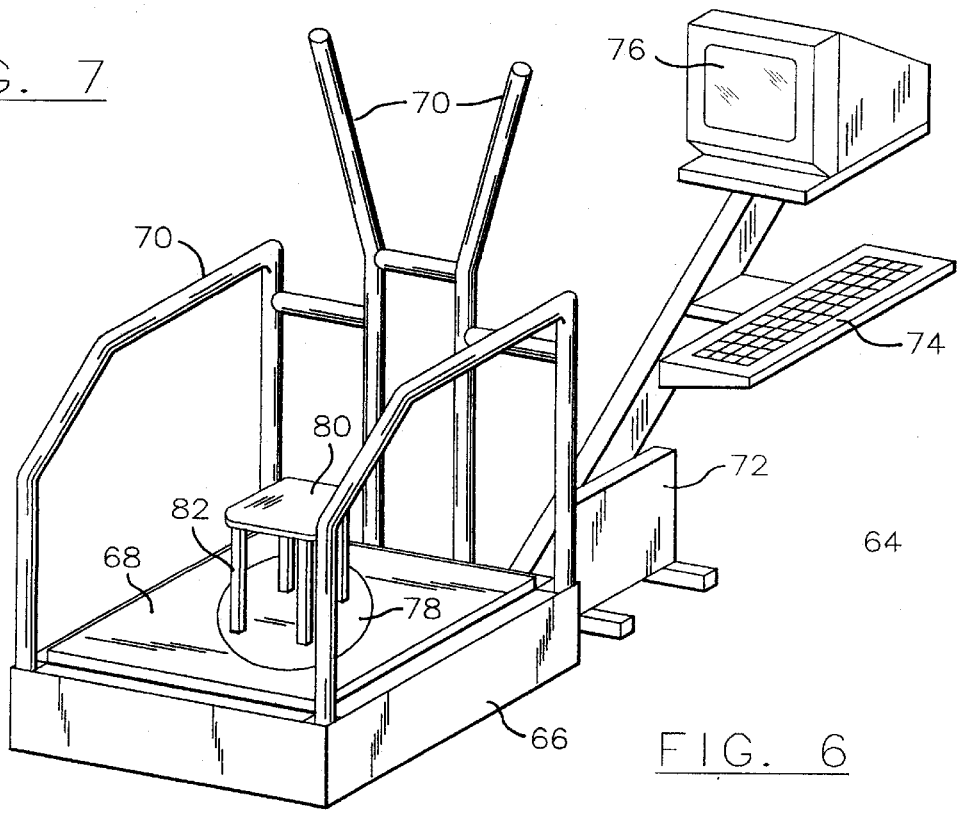
FIG. 6 is a perspective view of a platform utilizing the concepts of the invention as mounted upon a computerized diagnostic machine.

With reference to FIG. 6, a computerized system utilizing the inventive concepts is generally indicated at 64, and includes a frame 66 upon which a support surface 68 is mounted. Hand rails 70 vertically extend from the frame 66 and the support surface 68 is mounted upon weight sensors as will be apparent from the description of U.S. Pat. No. 4,986,534. The system includes a computer 72 receiving signals from the weight sensor supporting the support surface 68, and a keyboard 74 permits the output of the computer 72 to be displayed upon the CRT monitor 76. A circular platform 78, which may be identical to platform 10, is centrally mounted upon the support surface 68, and a seat 80 is mounted upon the platform 78 by a plurality of vertically extending columns 82. If desired, the single seat supported column shown in FIGS. 1 and 2 could also be utilized.

With the computerized system 64, nutating of the platform 78 upon the support surface 68 will apply the patient's weight to various locations upon the support surface 68 through the platform's periphery. This weight application to the support surface 68 is analyzed by the computer 72, and displayed upon the monitor 76 in the manner described in U.S. Pat. No. 4,986,534. Accordingly, the use of the inventive concepts in conjunction with the computer system of 64 provides a very accurate diagnosis of the weight distribution of the various platform periphery locations on the support surface 68, and if the patient is "favoring" certain muscles by not flexing them to the same extent as others in order to vary the weight distribution on the platform during each nutating cycle, the apparatus of system 64 will detect such fluctuations and differences in muscle flexing.

Figure 7:
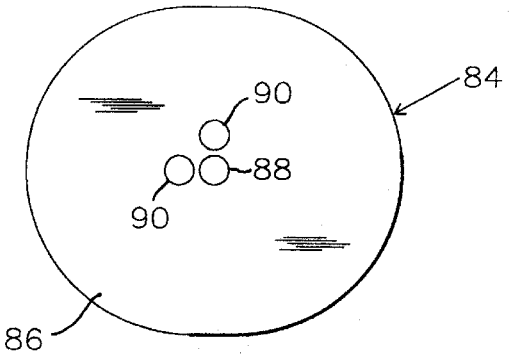
FIG. 7 is a top plan view of a platform of the invention showing a variation in platform periphery configuration, and illustrating variations in the mounting location of the seat support column.

FIG. 7 is a plan view of another platform configuration 84 which may be utilized having a non-circular periphery 86. The periphery 86 is of an oval configuration, and this type of platform peripheral configuration will produce a varying extent of dimensional offsetting from the vertical axis as the platform nutates. Such variations in nutation during each rotative cycle is advantageous with particular types of exercises desired. With an oval platform periphery configuration such as shown in FIG. 7, the seat socket may be centered as at 88, or off-centered as shown in the two instances of sockets 90 wherein the sockets are off-centered either toward the maximum peripheral dimension, or toward the minimal dimension. Of course, it is also possible to utilize off-center sockets with a platform having a circular periphery to vary the exercising characteristics.

In addition to varying the extent of exercise achieved with the apparatus of the invention by varying the size of the projection 44, 52 or 58, or by raising and lowering the height of the seat column 14, it is also possible to vary the exercises by the use of the arm rest 34 and seat back 36. Certain types of exercises are best performed when the using the arm rest and back rest, while other types of exercises are preferably performed without such seat accessories. Further, various amounts of control can be achieved by positioning the patient's position of the arms or legs, and the patient will follow the therapist's recommendations to achieve optimum therapeutic results. The exercise provided by the invention are primarily advantageous with respect to trunk and spinal maladies, but are also helpful for better neurological control leading to greater trunk stability. Lower back pain of many patients can be reduced by utilizing the invention, and patients requiring abdominal muscle strengthening and flexing, as well as shoulder rehabilitation, will be helped by the therapy provided by the invention. It is appreciated that various modifications to the inventive concepts may be apparent to those skilled in the art without departing from the spirit and scope of the invention.

We claim:

1. Therapy apparatus for the back and spine comprising, in combination, a platform formed of molded synthetic material having a central region, a periphery, a vertical axis, a convex upper side and a concave lower side, a plurality of reinforcement ribs homogeneously defined on said platform lower side radially extending from said central region and outwardly terminating short of said platform periphery, an elongated column having a lower end mounted on said platform central region and an upper end vertically spaced above said platform upper side, a seat mounted upon said column upper end in vertical spaced relation to said platform upper side and periphery, and a platform support mounted on said platform lower side at said central region extending below said platform lower side and periphery whereby upon a patient sitting upon said seat shifting weight relative to said platform vertical axis will cause said platform to nutate exercising the patient's back and spine.

2. In a therapy apparatus for the back and spine as in claim 1, wherein said platform support mounted on said platform lower side comprises a bulbous projection having a convex outer surface.

3. In a therapy apparatus for the back and spine as in claim 2 a threaded socket defined in said platform lower side central region concentric to said platform vertical axis, said bulbous projection having a threaded stem received within said socket whereby projections of variable dimension may be selectively mounted upon said platform lower side.

* * * * *